US006505448B2

(12) United States Patent
Ito

(10) Patent No.: US 6,505,448 B2
(45) Date of Patent: Jan. 14, 2003

(54) EXTERNAL WALL STRUCTURE

(75) Inventor: Hiroshi Ito, Aichi (JP)

(73) Assignee: Nichiha Corporation, Aichi (JP)

( * ) Notice: Subject to any disclaimer, the term of this patent is extended or adjusted under 35 U.S.C. 154(b) by 0 days.

(21) Appl. No.: 09/956,632

(22) Filed: Sep. 20, 2001

(65) Prior Publication Data

US 2002/0032999 A1 Mar. 21, 2002

(30) Foreign Application Priority Data

Sep. 20, 2000 (JP) ..... 2000-284865

(51) Int. Cl.[7] ..... E04B 2/00

(52) U.S. Cl. ..... 52/474; 52/396.04; 52/302.1; 52/718.04; 52/716.8; 52/718.01

(58) Field of Search ..... 52/718.04, 718.06, 52/718.01, 520, 716.8, 466, 468, 471, 302.1, 209

(56) References Cited

U.S. PATENT DOCUMENTS

| | | | | | |
|---|---|---|---|---|---|
| 2,184,249 | A | * | 12/1939 | Churchill | 24/295 |
| 2,671,538 | A | * | 3/1954 | Horowitz et al. | 52/464 |
| 4,241,552 | A | * | 12/1980 | Marulic | 52/282.4 |
| 4,553,361 | A | * | 11/1985 | Ralph | 49/408 |
| 5,611,185 | A | * | 3/1997 | Wilz | 52/395 |
| 5,649,399 | A | * | 7/1997 | Kepets | 52/169.7 |
| 5,783,020 | A | * | 7/1998 | Kress | 156/291 |
| 6,018,924 | A | * | 2/2000 | Tamlyn | 52/287.1 |
| 6,105,317 | A | * | 8/2000 | Tomiuchi et al. | 52/173.3 |
| 6,279,286 | B1 | * | 8/2001 | Ichihashi | 248/218.4 |
| 6,298,609 | B1 | * | 10/2001 | Bifano et al. | 52/101 |

FOREIGN PATENT DOCUMENTS

| | | | |
|---|---|---|---|
| JP | 9-195396 | | 7/1997 |
| JP | 10-61033 | | 3/1998 |
| JP | 10061033 | * | 3/1998 |
| JP | 11-62030 | | 3/1999 |
| JP | 11-71822 | | 3/1999 |
| JP | 11-81613 | | 3/1999 |
| JP | 2926162 | | 5/1999 |
| JP | 2001-123651 | | 5/2001 |

* cited by examiner

*Primary Examiner*—Carl D. Friedman
*Assistant Examiner*—Basil Katcheves
(74) *Attorney, Agent, or Firm*—Shook, Hardy & Bacon LLP

(57) ABSTRACT

An external wall structure of enhanced exterior design, which is provided with a decorative plate and can be constructed through a simple supplementary work. This external wall structure comprises a horizontally elongated draining member (20) which is secured to a furring strip (10), and a couple of upper and lower siding boards (1, 1) which are coupled with each other with the draining member (20) being interposed therebetween. This external wall structure is featured in that a horizontally elongated decorative plate (60) is mounted, via a plurality of fixtures (40) attached to the draining member (20), on a joint portion between said couple of upper and lower siding boards (1, 1), thus covering the joint portion.

6 Claims, 6 Drawing Sheets

EXTERNAL WALL STRUCTURE

BACKGROUND OF THE INVENTION

1. Field of the Invention

This invention relates to an external wall structure, and in particular, to an external wall structure of a joint portion between upper and lower siding boards of a longitudinal joint type.

2. Description of the Related Arts

In the siding work for the external wall of building, a plurality of longitudinal joint type siding boards are employed in such a manner that they are installed side by side and coupled with each other in the horizontal direction as well as in the vertical direction. For example, the coupling of these longitudinal joint type siding boards which are installed side by side in the horizontal direction is performed through a shiplap joint between the opposite sides of these boards, while the coupling of upper and lower longitudinal joint type siding boards through their longitudinal sides is performed using a horizontally elongated draining member which is designed to be interposed between these siding boards.

FIG. 5 shows one example of such a coupling method, wherein a horizontally elongated draining member 20 is secured by means of nail 5 to a horizontal furring strip 10 of a building wall, and then an upper siding board 1 and a lower siding board 1 are coupled with each other with this draining member 20 being interposed therebetween. In this example, as shown in FIG. 6 illustrating a perspective view thereof, the draining member 20 is constituted by a horizontally elongated substrate 21, and a couple of board-receiving portions 24 and 25 protruded externally from the substrate 21 and provided with an upward holder portion 22 and a downward holder portion 23, respectively, so that a lower end portion 3 of the upper siding board 1 is enabled to be fitted in the upward holder portion 22, while an upper end portion 3 of the lower siding board 1 is enabled to be fitted in the downward holder portion 23. Further, the upper board-receiving portion 24 of draining member 20 is provided with a elliptical drain hole 26 to thereby allow rain water running down through the siding board 1 to be discharged via this drain hole 26 out of the upper board-receiving portion 24. By the way, this draining member 20 is provided with a plurality of spacer ribs 27 which are protruded at predetermined intervals from the rear surface of the substrate 21, thereby enabling a gap to be formed for ventilation on the rear side of substrate 21 as the draining member 20 is secured to the horizontal furring strip 10 (see Japanese Patent Unexamined Publication 2000-160804, for instance).

According to this external wall structure wherein a couple of siding boards are coupled with each other through their longitudinal sides by making use of a horizontally elongated draining member which is attached in advance to a building wall and designed to be interposed between these siding boards as shown in FIG. 5, a portion of the draining member (the board-receiving portions 24 and 25, in this example) is permitted to expose to the outside. Although there is not any particular inconvenience in itself as an external wall structure, it is occasionally desired that the aforementioned exposed portion of draining member is also covered with a decorative end rail for enhancing the design of the external wall.

SUMMARY OF THE INVENTION

This invention has been accomplished with a view to response to such a demand, and therefore, an object of the present invention is to provide an external wall structure, which makes it possible to cover a portion of draining member which is exposed to the outside with a desired decorative plate through a simple supplementary work on the occasion of installing siding boards or even after the installation of siding boards.

With a view to realize the aforementioned object, this invention provides an external wall structure, which comprises a horizontally elongated draining member which is secured to a building wall, and a couple of upper and lower siding boards which are coupled with each other with said draining member being interposed therebetween; wherein a horizontally elongated decorative plate is mounted via a fixture on a joint portion between said couple of upper and lower siding boards, thereby covering said joint portion.

As for the specific configuration of the draining member to be employed in this invention, there is not any particular limitation as long as it is capable of draining water as it is interposed between a couple of upper and lower siding boards. For example, the draining member may be such as shown in FIGS. 5 and 6 wherein the draining member is provided with a couple of holder portions for enabling a lower end portion of the upper siding board and an upper end portion of the lower siding board to be fitted in the holder portions, respectively. Alternatively, the draining member may be such that it comprises a slanted plate portion having a pent roof configuration so as to cover an upper end portion of lower siding board, and a perpendicular draining plate portion.

In the siding work, a horizontally elongated draining member is secured by means of nail, etc. to a horizontal furring strip of building wall, and at the same time, siding boards are coupled with each other in the longitudinal direction thereof as well as in the elevational direction thereof. During or subsequent to this siding work, a required number of fixtures are attached at predetermined intervals to the draining member by any suitable means. Thereafter, by taking advantage of these fixtures attached in this manner, a horizontally elongated decorative plate is mounted on the joint portion between a couple of upper and lower siding boards (i.e. a portion of draining member which is exposed to the outside), thereby covering the joint portion. Preferably, the fixture is provided at the upper and lower ends thereof with a horizontally extending locking end, while the decorative plate is provided at the upper and lower edges thereof with a hook which is designed to be engaged with the corresponding locking end of the fixture. Accordingly, the hooks of the decorative plate are enabled to be easily engaged with the locking ends of the fixture, respectively, when the decorative plate is pushed against the fixture, thereby enabling the decorative plate to be easily integrated with the fixture, thus resulting in an assembled structure which can be hardly disintegrated once these components are engaged with each other as described above.

It is possible according to the external wall structure of this invention to cover the joint portion between upper and lower siding boards, i.e. a portion of draining member which is exposed to the outside with a desired decorative plate through a simple supplementary work on any occasion as desired, thereby making it possible to easily obtain an external wall surface having an enhanced exterior design.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
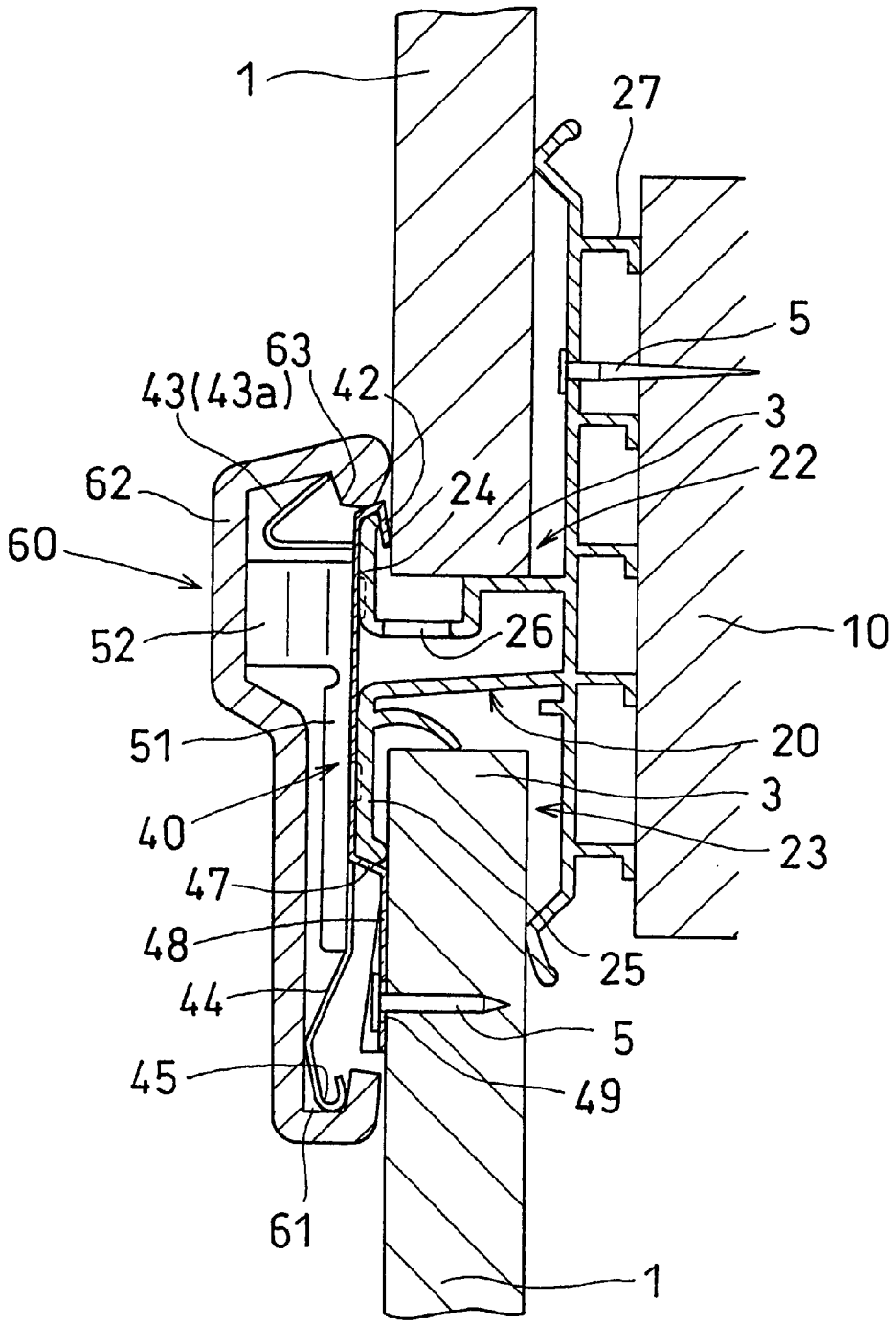
FIG. 1 is a longitudinal sectional view illustrating one embodiment of the external wall structure according to this invention.
Figure 2:
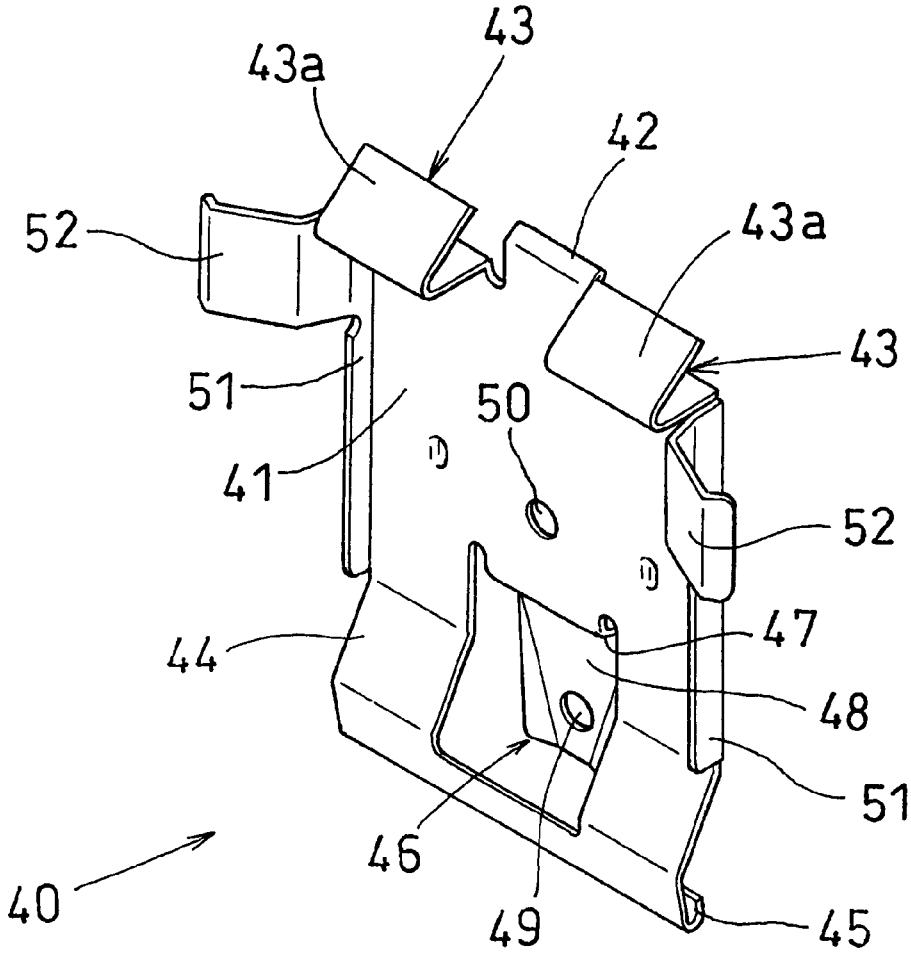
FIG. 2 is a perspective view illustrating one embodiment of the fixture according to this invention.
Figure 3:
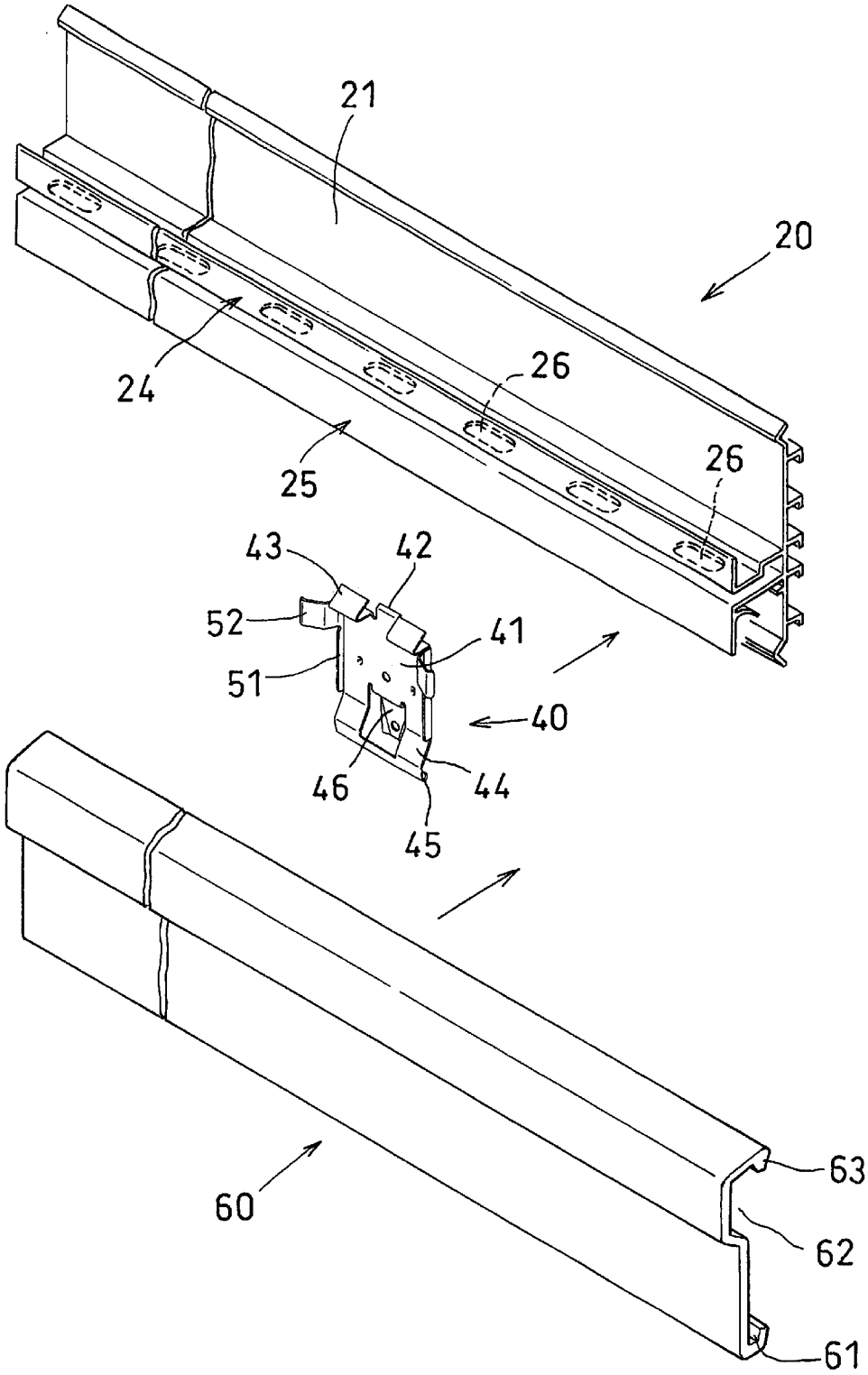
FIG. 3 is an exploded perspective view illustrating a main portion of the external wall structure shown in FIG. 1.

Preferable embodiments of this invention will be explained in details below with reference to the drawings. FIG. 1 shows a longitudinal sectional view illustrating one embodiment of the external wall structure according to this invention; FIG. 2 shows a perspective view illustrating one embodiment of the fixture according to this invention; and FIG. 3 shows an exploded perspective view illustrating a main portion of the external wall structure shown in FIG. 1.

Figure 5:
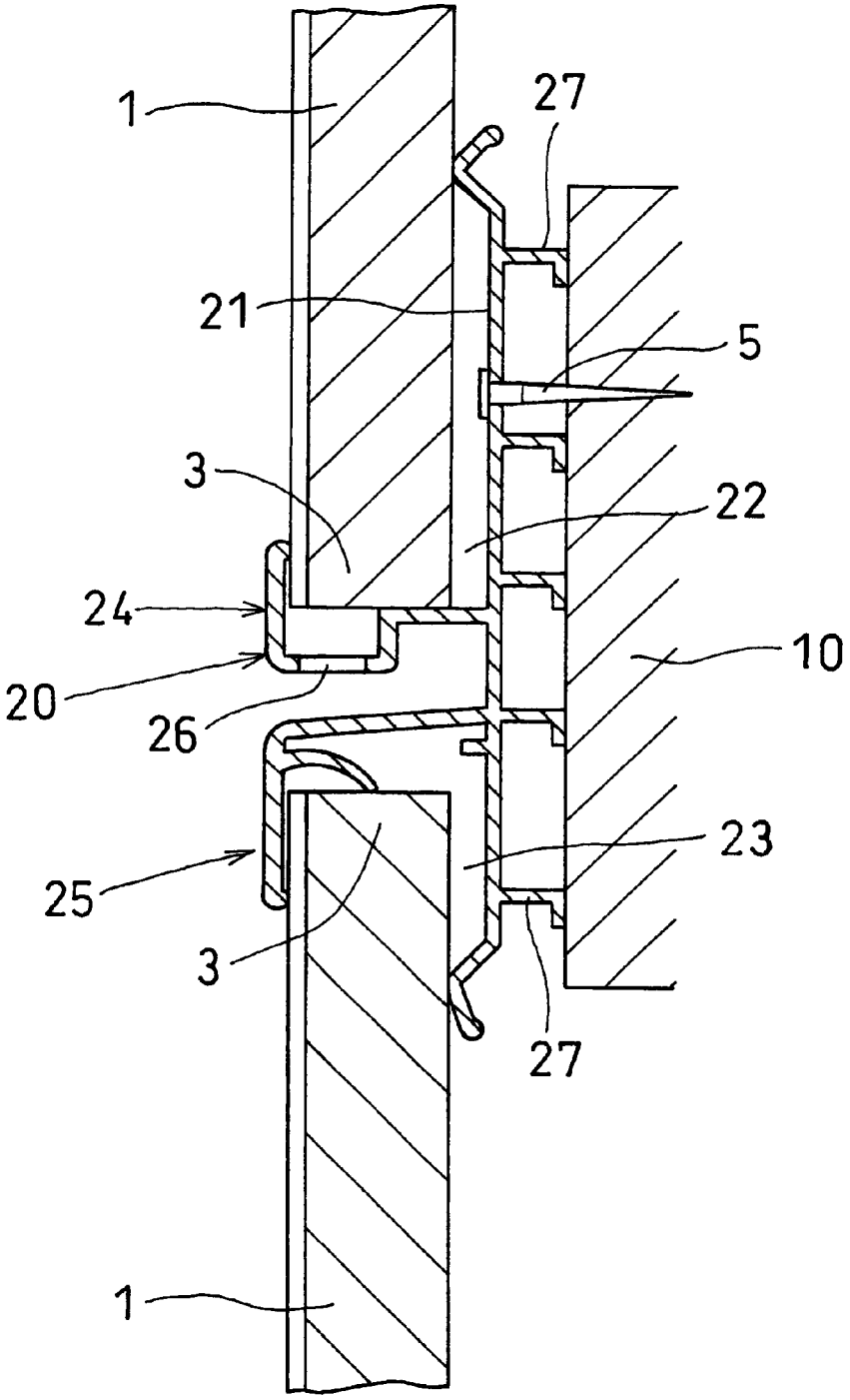
FIG.5 PRIOR ART
FIG. 5 is a longitudinal sectional view illustrating the external wall structure where a conventional draining member is employed.
Figure 6:
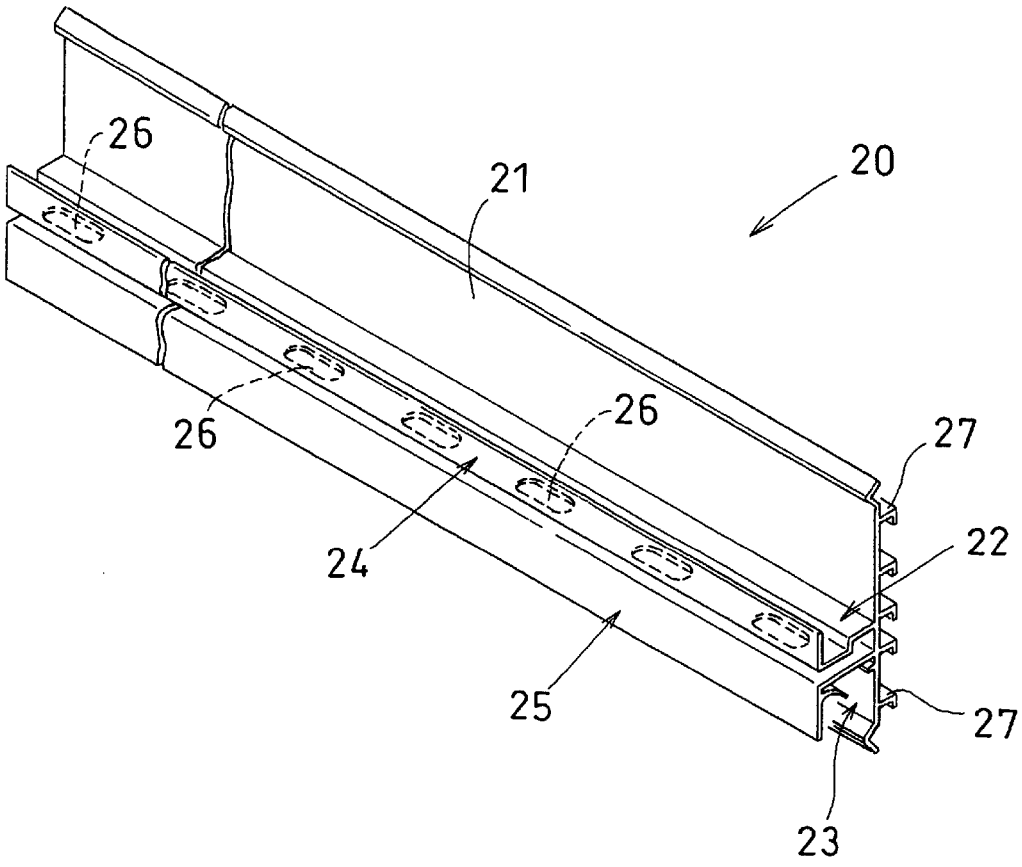
FIG.6 PRIOR ART
FIG. 6 is a perspective view illustrating one example of the draining member.

In the external wall structure of this invention, the draining member which is designed to enable a couple of longitudinal joint type siding boards to be coupled with each other in an elevational direction may be of any structure which is conventionally known as long as it is capable of allowing a fixture (to be explained hereinafter) to be attached thereto. Therefore, in the following explanation, the draining member 20 explained with reference to FIGS. 5 and 6 is employed for the convenience of explanation, and hence the same components as those of FIGS. 5 and 6 are identified by the same reference numbers in FIGS. 1 and 3, thereby omitting the explanation regarding the draining member 20 as well as regarding the coupled state between the draining member 20 and the siding boards 1. The external wall structure of this invention is featured in that it is additionally provided, as new constituent members, with a fixture 40 and a horizontally elongated decorative plate 60.

The fixture 40 shown in FIG. 2 is manufactured by working steps comprising a punching work of steel board, and a bending work of the punched steel board. As clearly shown in FIG. 1, the fixture 40 comprises a substrate 41 which is designed to be contacted with the regions of the board-receiving portions 24 and 25 of the draining member 20, which are exposed to the outside. A central portion of the upper edge of the substrate 41 is bent rearward so as to form a hook 42, and the opposite side portions of the upper edge of the substrate 41, which are located on both sides of the aforementioned central portion, are also bent so as to protrude forward, thereby forming a couple of upper locking portions 43. As shown in the drawings, each of the upper locking portions 43 comprises an upwardly slanted surface 43*a*, which is adapted to be inclined downward as it is pushed from the outside thereof by an external force, but is capable of returning its original position as the load due to this pushing force is released. A lower portion of the substrate 41 is bent forward so as to form a slanted portion 44, the lower edge of this slanted portion 44 is bent rearward so as to form a lower locking portion 45.

A lower central portion of the substrate 41 including a central portion of the slanted portion 44 is cut and raised to form a tongue portion 46. This tongue portion 46 is cut along its right, left and lower sides. The tongue portion 46 is constituted by an inclined portion 47 which is inclined rearward, and a vertical strip 48 formed contiguous to the inclined portion 47 and provided with a nailing hole 49. The substrate 41 is further provided at a central portion thereof with a hole 50. The opposite right and left sides of the substrate 41, are bent forward, forming a pair of rising portions 51. The substrate 41 in this embodiment is further provided, at upper opposite sides thereof, i.e. at the positions over the rising portions 51, with a pair of arms 52 which are expandingly extended forward.

By the way, the position and configuration of the hook 42 and the inclined portion 47 of tongue portion 46 in the fixture 40 are determined depending on the position and size of the board-receiving portions 24 and 25 of the draining member 20 to which the fixture 40 is attached. On the other hand, the position and configuration of the upper locking portions 43, the lower locking portion 45, the rising portions 51 and the arms 52 are determined depending on the position and size of the rear side of the horizontally elongated decorative plate 60 to be mounted on the fixture 40.

In the constructing work of the external wall structure according to this invention, first of all, after the draining member 20 is secured to a building wall, the upper and lower siding boards 1 are coupled with each other with the draining member 20 being interposed therebetween as shown in FIG. 5. Under this condition, a plurality of the fixtures 40 are attached predetermined intervals to the draining member 20. This attachment of the fixtures 40 can be performed by allowing the hook 42 to engage with an upper edge of the upper board-receiving portion 24 of draining member 20 at first, and under this condition, by pushing the fixtures 40 toward the board-receiving portions 24 and 25 as shown in FIG. 1.

As a result, the inclined portion 47 of tongue portion 46 is permitted to contact with a lower edge of the lower board-receiving portion 25, and at the same time, the vertical strip 48 of tongue portion 46 is permitted to contact with the surface of siding board 1 disposed at a lower position. Under this condition, a nail 5 is driven through the nailing hole 49 into the siding board 1, thereby accomplishing the attachment of the fixture 40 to the draining member 20. Thereafter, the same procedures as mentioned above are repeated for attaching a required number of fixtures 40 to be arranged in the horizontal direction.

Subsequently, the horizontally elongated decorative plate 60 as shown in FIG. 3 is mounted on the fixture 40 which has been attached to the draining member 20. As a result, the joint portion between the upper and lower siding boards 1 is covered with the decorative plate 60, thereby making it possible to obtain an external wall surface having an enhanced exterior design. In this embodiment, the decorative plate 60 comprises a U-shaped groove 61 formed along a lower edge thereof, an upper swelled portion 62, and a downward brim (or hook) 63 which is formed along an upper edge thereof. Therefore, the decorative plate 60 can be fixed to the fixture 40 as follows. First of all, the U-shaped groove 61 of decorative plate 60 is pushed upward from below the lower locking portion 45 of fixture 40, thereby permitting the U-shaped groove 61 to be engaged with the lower locking portion 45, and while keeping this state, the decorative plate 60 is entirely pushed toward the fixture 40. As a result, the downward brim 63 is at first contacted with the upwardly slanted surfaces 43*a* of upper locking portions 43 of the fixture 40, and then, moved, while displacing downward and passing over this slanted surfaces 43*a*, to take a stable mounted state as shown in FIG. 1. When the decorative plate 60 is brought into this state, the arms 52 which are formed integral with the rising portions 51 are permitted to contact with the rear side of the swelled portion 62 of decorative plate 60, thereby pushing the decorative plate 60 in the forward direction, thus further stabilizing the mounted state of the decorative plate 60.

Figure 4:
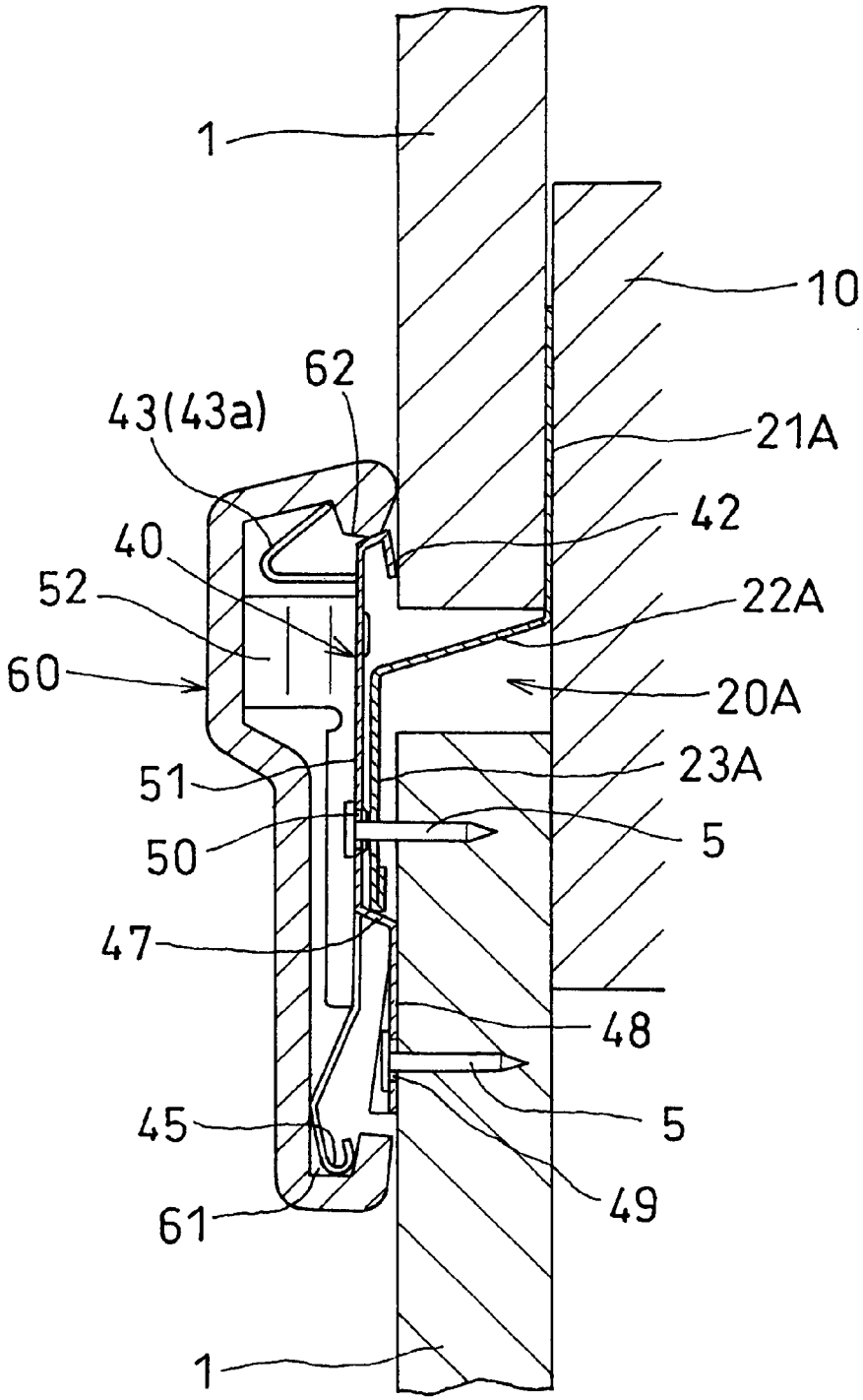
FIG. 4 is a longitudinal sectional view illustrating another embodiment of the external wall structure according to this invention.

FIG. 4 illustrates another embodiment of the external wall structure according to this invention, which is featured in that only the structure of draining member differs from that in the foregoing embodiment. Namely, this draining member 20A is constituted by a horizontally elongated substrate 21A, an inclined plate portion 22A extending obliquely downward in a forward direction from the lower end of the horizontally elongated substrate 21A, and a draining portion 23A extending downward from the lower end of the inclined plate portion 22A. A couple of siding boards 1 are attached, with this draining member 20A being interposed therebetween, to a building wall by making use of fastening means (not shown).

The fixture 40 in this embodiment is the same as that shown in FIGS. 1 to 3. The inclined portion 47 of the tongue portion 46 is permitted to contact with the lower edge of the draining portion 23A of draining member 20A which has been secured to the horizontal furring strip 10, thereby achieving the positioning of the fixture 40. Thereafter, a nail 5 is driven through the draining member 20A into the siding board 1 by making use of the hole 50 formed at a central portion of the substrate 41. As a result, the fixture 40 can be fixed to the draining member 20A. Additionally, by taking advantage of the nailing hole 49 formed in the tongue portion 46, a nail 5 may be driven into the siding board 1. The mounting of the decorative plate 60 onto the fixture 40 that has been fixed to as explained above can be carried out in the same manner as explained with reference to FIGS. 1 to 3.

The foregoing explanation is directed to some of preferable embodiments of the external wall structure according to this invention, and therefore, this invention is not limited to the aforementioned embodiments. Namely, the object of this invention can be achieved as long as the fixture is constructed so as to enable it to be secured to the draining member that has been fixed to a building wall, and a decorative plate can be mounted by making use of this fixture on a joint portion of upper and lower siding boards, thus covering this joint portion. As already mentioned above, there is not any particular limitation with respect to the specific configuration of the draining member, the fixture and the decorative plate.

According to this invention, it is possible to provide an external wall structure, which makes it possible to cover a portion of draining member which is exposed to the outside with a desired decorative plate through a simple supplementary work of attaching a fixture to the draining member on the occasion of installing siding boards or even after the installation of siding boards, thereby making it possible to obtain an external wall surface having an enhanced exterior design.

What is claimed is:

1. An external wall structure, comprising:

a horizontally elongated draining member which is secured to a building wall; and a couple of upper and lower siding boards which are coupled with each other with said draining member being interposed therebetween, said draining member comprising an upward holder portion for holding the upper siding board, which is provided with drain holes;

a downward holder portion for holding the lower siding board; and and wherein said fixture comprises:

a hook portion hung on the draining member;

a fixing portion for fixing the fixture to the lower siding board; and upper and lower locking portions locked in the upper and lower portions of the decorative plate;

wherein a horizontally elongated decorative plate is mounted via a fixture on a joint portion between said couple of upper and lower siding boards, thereby covering said joint portion.

2. An external wall structure according to claim 1, wherein the fixture further comprises at least one arm which pushes the rear surface of the decorative plate.

3. An external wall structure, comprising:

a horizontally elongated draining member which is secured to a building wall; and a couple of upper and lower siding boards which are coupled with each other with said draining member being interposed therebetween, said draining member comprising a horizontally elongated substrate;

an upward holder portion and a downward holder portion extending forward from the substrate, the upward holder portion being provided with a drain hole; and a plurality of spacer ribs which are protruded from the rear surface of the substrate;

and wherein said fixture comprises:

a substrate;

a hook portion in the middle of the upper edge of the substrate, which is hung on the upper edge of the upward holder portion of the draining member;

a couple of upper locking portions extending forward from the opposite side portions of the upper edge of the substrate, each of the upper locking portions comprising an upwardly slanted surface;

a slanted portion extending forward from a lower portion of the substrate;

a lower locking portion at the lower edge of the slanted portion;

a tongue portion extending backward from a lower central portion of the substrate and being provided with a nailing hole;

a pair of rising portions extending forward on the opposite right and left sides of the substrate; and a pair of arms on upper opposite sides of the substrate which push the rear surface of the decorative plate;

wherein a horizontally elongated decorative plate is mounted via a fixture on a joint portion between said couple of upper and lower siding boards, thereby covering said joint portion.

4. An external wall structure according to claim 3, wherein said fixture is formed of a single plate.

5. An external wall structure, comprising:

a horizontally elongated draining member which is secured to a building wall, said draining member comprising a horizontally elongated substrate;

an inclined plate portion extending obliquely downward in a forward direction from the lower end of the horizontally elongated substrate; and a draining portion extending downward from the lower end of the inclined plate portion;

wherein said fixture comprises:

a substrate;

a couple of upper locking portions extending forward on the opposite side portions of the upper edge of the substrate, each of the upper locking portions comprising an upwardly slanted surface;

a slanted portion extending forward from a lower portion of the substrate;

a lower locking portion at the lower edge of the slanted portion;

a tongue portion extending backward from a lower central portion of the substrate and being provided with a nailing hole;

a pair of rising portions extending forward from the opposite right and left sides of the substrate; and a pair of arms at upper opposite sides of the substrate which push the rear surface of the decorative plate;

wherein said inclined portion of the tongue portion of the anchoring member contacts with the lower edge of the draining portion of the draining member which has been secured to a horizontal furring strip; and a couple of upper and lower siding boards which are coupled with each other with said draining member being interposed therebetween;

wherein a horizontally elongated decorative plate is mounted via a fixture on a joint portion between said couple of upper and lower siding boards, thereby covering said joint portion.

6. An external wall structure according to claim 5, wherein said fixture is formed of a single plate.

* * * * *